US008002046B2

(12) United States Patent
Neeb et al.

(10) Patent No.: US 8,002,046 B2
(45) Date of Patent: Aug. 23, 2011

(54) APPARATUS FOR REDUCING THE INCIDENCE OF TAMPERING WITH AUTOMATIC FIRE SPRINKLER ASSEMBLIES

(76) Inventors: Daniel A. Neeb, Aventura, FL (US); Thomas P. MontAlto, Richfield, OH (US)

( * ) Notice: Subject to any disclaimer, the term of this patent is extended or adjusted under 35 U.S.C. 154(b) by 229 days.

(21) Appl. No.: 12/469,818

(22) Filed: May 21, 2009

(65) Prior Publication Data

US 2010/0089597 A1 Apr. 15, 2010

Related U.S. Application Data

(60) Provisional application No. 61/104,337, filed on Oct. 10, 2008.

(51) Int. Cl.
*A62C 37/08* (2006.01)

(52) U.S. Cl. ..... 169/37; 169/39

(58) Field of Classification Search ..... 169/37, 169/38–42, 57, 68; 239/200, 201, 203, 204, 239/288, 288.3, 288.5
See application file for complete search history.

(56) References Cited

U.S. PATENT DOCUMENTS

| | | | | |
|---|---|---|---|---|
| 3,818,994 | A * | 6/1974 | Livingston | 169/37 |
| 3,831,682 | A * | 8/1974 | Calcaro | 169/37 |
| 3,998,273 | A | 12/1976 | Juliano | |
| 4,303,395 | A | 12/1981 | Bower | |
| 4,418,336 | A | 11/1983 | Taylor | |
| 4,590,999 | A | 5/1986 | Snaper | |
| 5,460,228 | A | 10/1995 | Butler | |
| 6,225,914 | B1 | 5/2001 | Weng | |
| 6,232,886 | B1 | 5/2001 | Morand | |
| 6,768,424 | B1 | 7/2004 | Morris | |
| 6,816,072 | B2 | 11/2004 | Zoratti | |
| 7,188,679 | B2 | 3/2007 | McSheffrey | |
| 7,271,704 | B2 | 9/2007 | McSheffrey | |
| 2006/0283608 | A1 | 12/2006 | Hauck | |
| 2008/0197133 | A1 * | 8/2008 | McKay et al. | 220/359.1 |
| 2009/0166047 | A1 | 7/2009 | Sundholm | |

FOREIGN PATENT DOCUMENTS

| | | |
|---|---|---|
| DE | 202005005243 U | 6/2005 |
| JP | 02-520406 | 9/1998 |
| JP | 2005-027769 | 2/2005 |
| JP | 2005-058588 | 3/2005 |

(Continued)

OTHER PUBLICATIONS

IPR—International Publication WO/2010/042956, published Apr. 15, 2010 for PCT/US09/065628, filed Nov. 24, 2009.

(Continued)

*Primary Examiner* — Davis Hwu
(74) *Attorney, Agent, or Firm* — Fleit Gibbons Gutman Bongini & Bianco, PL; Gary S. Winer; Paul D. Bianco

(57) ABSTRACT

A fire sprinkler head anti tamper canopy discourages hanging objects from a sprinkler head, or otherwise tampering or accidentally activating a sprinkler head. The canopy encloses the projecting portion of a sprinkler head, at least around the sides of the sprinkler head, and allows heat to enter and activate the sprinkler head, and water to escape from the sprinkler head for fire suppression. The canopy is magnetically secured to the wall or ceiling surface, without a requirement for physical attachment to the sprinkler head. Upon sprinkler head activation, water pressure dislodges the canopy, the latter returnable to an anti-tamper position once the fire sprinkler system has been reset.

20 Claims, 4 Drawing Sheets

FOREIGN PATENT DOCUMENTS

| | | |
|---|---|---|
| KR | 20-0438885 | 3/2008 |
| WO | WO0215981 | 2/2002 |
| WO | WO2006105758 | 10/2006 |

OTHER PUBLICATIONS

ISR—International Search Report, dated May 20, 2010 for PCT/US09/065628, filed Nov. 24, 2009.

Written Opinion dated May 20, 2010 for PCT/US09/065628, filed Nov. 24, 2009.

The definition of "enclose" Your Dictionary.com—http://www.yourdictionary.com, retrieved Jun. 1, 2011.

* cited by examiner

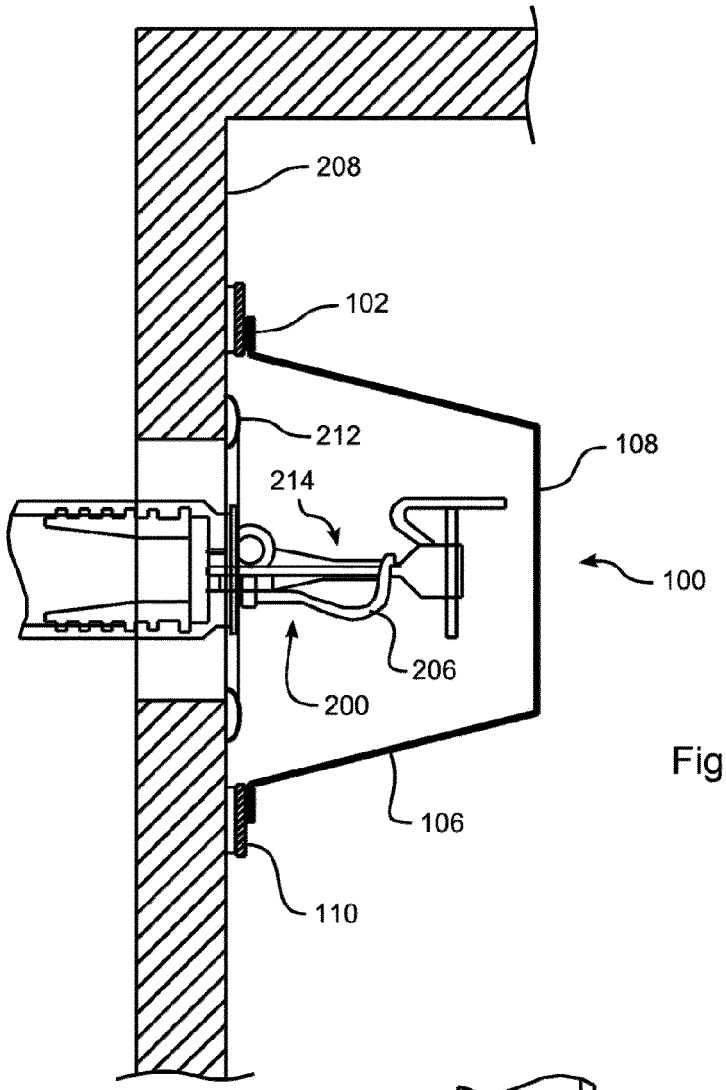
Fig. 1
Fig. 2
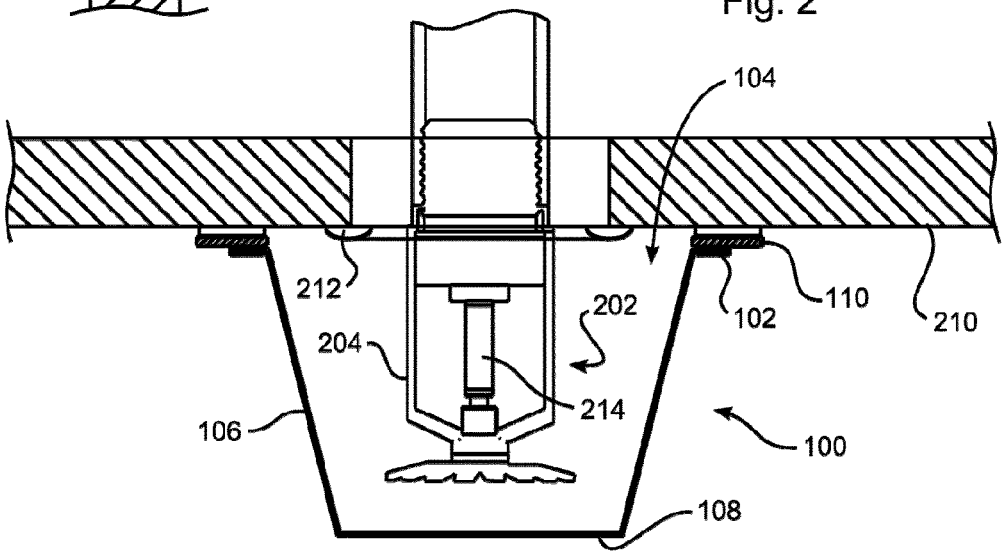

APPARATUS FOR REDUCING THE INCIDENCE OF TAMPERING WITH AUTOMATIC FIRE SPRINKLER ASSEMBLIES

FIELD OF THE INVENTION

The invention relates to a system and method for reducing the incidence of tampering with automatic fire sprinkler assemblies, and in particular, sprinkler heads.

BACKGROUND OF THE INVENTION

Over the last fifty years, at least, automatic fire protection systems have become widely employed in various facilities throughout the world as a means to save lives, and to limit damage to physical property in the event of a fire. The design of the components associated with these systems has evolved during this time, and a significant number of different sprinkler head trigger configurations have evolved. These designs typically include a flow valve whose operation is initiated by varying mechanical methods, each of which are responsive to heat.

These varying trigger configurations are activated in response to a predetermined amount of heat, or heat load. When the trigger is subjected to a predetermined heat load, the rigidity of a trigger component is compromised. This trigger component typically takes the form of a fusible link assembly, or a frangible bulb assembly, within the sprinkler head. When the rigidity of the trigger assembly is compromised by heat, it collapses and the sprinkler head valve is opened, thereby allowing the flow of water through the sprinkler head assembly, at a predetermined flow rate, into the building. The sprinkler head assembly may be either surface mounted, partially recessed, or fully recessed. An escutcheon or cover plate is typically used as an aesthetic surface trim piece at the perimeter of the hole in the wall, ceiling or ceiling surface through which the head assembly projects.

Significant financial losses have been sustained by building owners or occupants as a result of tampering with sprinkler head assemblies. This loss most often occurs when an attempt is made by the occupant to use the exposed sprinkler head assembly as a device from which to hang various personal articles, as with a clothes hanger. In particular, most designs incorporate a bail or loop of metal which serves to protect the head from physical impact, and may also form part of the trigger structure. From the perspective of an unknowing or unconcerned person, the bail structure appears to be a convenient hook for a hanger, particularly for airing out or drying wet garments.

As a result of this action by the occupant, the fusible link assembly may become inadvertently dislodged or broken, and consequently water flows through the sprinkler head assembly. The pressure and or flow rate from a sprinkler line is usually much greater than from drinking water supply lines, and thus a very large quantity of water may be discharged inside the building within a relatively short period of time.

This action typically causes significant water damage to the flooring, floor covering, furniture, finishes and fixtures within the affected space, necessitating replacement of those damaged items and materials. In addition, the affected space may include floors beneath the discharged sprinkler line. All of the affected space may not be usable until repaired, representing lost rents or revenue, business interruption losses, and diminished productivity. Additionally, the discharge may also require the replacement of portions of the sprinkler head assembly and a resetting of the sprinkler system by qualified technicians, together with testing and reporting, all at considerable expense. Moreover, unless timely notified of a false alarm, fire rescue and other emergency personnel may respond to an automatic signal transmitted as a result of the sprinkler head activation, incurring costs to the municipality, and possibly the building owner.

A cover for a sprinkler head is disclosed, for example, in International Application PCT/DE2006/000538 to Schnell, for use with a concealed sprinkler head. In Schnell, a cover is ejected by a bimetal strip in the presence of heat. Fully recessed sprinklers, as are disclosed in Schnell, are not as prone to tampering by hangers and the like. Thus, Schnell does not disclose a solution for tampering with exposed sprinkler heads.

Another cover is disclosed in U.S. Pat. No. 3,998,273 to Juliano, again for a recessed head. Juliano provides, instead of the bimetal of Schnell, a magnetic engagement for the cover, where the magnet is retained by glue which melts in the presence of an amount of heat sufficient to activate the sprinkler head.

Thus, Schnell and Juliano provide a cover for sprinkler heads for aesthetic purposes and not to prevent tampering, and are limited to recessed sprinkler head designs. Moreover, each design requires a release mechanism which increases the cost of the device. In addition, the covers, release mechanisms, and attachment means of Schnell and Juliano are integrated into the sprinkler head apparatus. That is, they are installed together with the sprinkler head, and thus are not installable without shutting down the sprinkler system, draining it, physically replacing the heads, and rearming the system. This can be a time consuming and expensive process, which leaves the facility unprotected against fire until all heads can be replaced. Many building require hundreds or thousands of heads, and thus replacing heads is simply not a viable option.

To further discourage or reduce the incidence of tampering, it is desirable to notify a prospective tamperer of the potential danger of their actions. An alarm mechanism is disclosed in International Application PCT/GB01/03775, which provides for the breaking of an electrical connection upon melting soldered connections which secure a cover. This device is not directed to tampering, however, but rather to notify that the cover circuit has melted, indicating a fire. Moreover, the alarm signal is received only at a central location, not near the sprinkler head, and does not signal an undesired condition until it is too late. In addition, this device is also integrated or incorporated into the sprinkler head design.

Accordingly, a need remains for a device which will notify an individual not to tamper with a sprinkler head. Further, it is desired to have a tamper deterring device which works with exposed heads, which are more likely to be tampered with, particularly by a hanger, than recessed heads. In addition, there remains a need for an anti tamper device which can be added to existing fire sprinkler systems without a need for replacing sprinkler heads, shutting down the sprinkler system, or performing any other labor intensive modifications.

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 CFR §1.56(a) exists.

SUMMARY OF THE INVENTION

The invention provides for discouraging and thereby reducing the incidence of tampering with fire safety equipment, and in particular, with exposed sprinkler heads. In accordance with the invention, the device serves as a deterrent by obscuring the sprinkler head from view, and in addition, the sprinkler head cannot be misused without removal of the device itself.

In accordance with an embodiment of the invention, a mesh or woven cover or canopy sized to enclose an exposed portion of a sprinkler head is provided with an engagement flange. The canopy has at least one open end, and in one embodiment, has an open end, enclosed sides, and a closed end. An attachment plate, in one embodiment a plate having the shape of a ring having a diameter corresponding to the diameter of the canopy, is attached to the wall or ceiling surface ("surface") adjacent to the sprinkler head. A magnet is attached to either the flange or plate, whereupon the other of the two parts includes a magnet or magnetically active material, such as a ferromagnetic material. In this manner, the canopy is releasably magnetically retained upon the adjacent surface. Due to the open weave or aperture of the canopy, heat may readily enter the canopy and activate the sprinkler head as intended. When the sprinkler head is activated, discharged water engages the mesh or body of the canopy, and or a plate disposed at a closed end of the canopy, and by action of the water pressure, the canopy is pushed away, breaking a magnetic bond which is configured to be weak relative to the force of released water. The ready admission of heat, combined with a quick release of the canopy, ensures no impact to the performance of the fire suppression system.

The mesh size, or aperture size within the canopy is selected to advantageously visibly obscure the sprinkler head, reducing a temptation to use the sprinkler head for an improper purpose. Concomitantly, the mesh or aperture size must be large enough to avoid adversely impacting the performance of the sprinkler head, and more particularly, must not introduce a measurable or significant delay in activation.

In a typical sprinkler head installation, a standard escutcheon ring is installed during construction, to cover the cut or exposed surface through which the sprinkler head projects. In accordance with the invention, the attachment plate is sized to surround this escutcheon, enclosing it within the canopy. In one embodiment, the escutcheon may be omitted, reducing construction costs, and the attachment flange and canopy may be sized correspondingly smaller. A canopy mesh size may be selected to visually obscure an exposed wall surface within the canopy, while adequately admitting heat.

In another embodiment, a device in accordance with the invention is attached to the escutcheon itself, either magnetically, or through an adhesive layer as otherwise described herein, with respect to attachment to the surface.

In accordance with the invention, the attachment plate is adhered to the ceiling by adhesive applied to the surface contacting side thereof. Alternatively, double sided adhesive tape or foam may be applied to either the attachment plate or surface, after which the attachment plate is bonded to the surface. The double sided tape or foam can be applied in a factory production process, or applied at the installation site. In either event, the unattached adhesive side or sides have a protective release layer, which is removed prior to application. Alternatively, during new construction in particular, the attachment plate may be adhered to the ceiling when same is wet and curing, or through the application of liquid glue to the plate, the surface, or both. Further, the attachment plate, or discrete members as described below, may be attached to the surface using any known means, including screws, rivets, nails, or any other known form of bonding.

In one embodiment, the attachment plate is a plastic or metallic ring with magnetic material bonded or otherwise affixed thereto. Alternatively, the attachment plate may be a ring shaped magnet, or ring of magnetized material. Where the canopy engagement flange contains magnetic material, the attachment ring may merely be magnetically active, for example containing a ferrous material. Both the engagement plate and the attachment ring may alternatively be magnetic, however in this embodiment the respective poles must be appropriately aligned on each surface in order to produce an attraction therebetween.

While the canopy is described as being meshed, it should be understood that slits or other aperture shapes may be provided in the canopy surface, provided that there is sufficient passageway for heat, and thus sprinkler activation.

Moreover, while the canopy is advantageously manufactured in a round shape, such as a cylinder or conical frustum (as illustrated in the figures), a pyramidal frustum, cylinder, or other shape which is sized and shaped to at least partially surround the sprinkler head, or is otherwise shaped to shield and impede access to the trigger, may be used, and is therefore contemplated as within the scope of the invention.

Similarly, the attachment plate is provided with a shape complementary to the canopy engagement flange. Further, the attachment plate may be composed of a plurality of discrete elements which are separately attached to the surface, thereby reducing the total amount of material needed. In this event, a template may be provided to facilitate attachment, or alternatively, the discrete attachment member parts may be magnetically connected first to the engagement flange, and subsequently adhered or attached to the surface after being thus properly aligned.

In accordance with a further embodiment of the invention, an electronic sound generating device is connected to the canopy, operative to respond to a movement of the canopy. The sound generating device emits an alarm noise, or plays a recorded message in at least one language, notifying individuals proximate the canopy not to move or remove the canopy from its installed location. The message may further warn of the rationale or consequences of a failure to heed the warning. In addition, the message may repeat until the device is replaced in its correct location. Detection of replacement or removal of the device may be by a magnetic switch, mechanical switch, or other means as known in the art.

In addition to, or in place of an audible message, a signal may be sent to a central administration site, as by wired or wireless transmission, whereby persons responsible for maintenance or safety can ensure that the canopy is replaced, or that further measures may be taken to ensure that the sprinkler system is not tampered with further.

In accordance with another embodiment of the invention, written indicia, either symbolic or in at least one written language, are provided in a prominent visible location on the canopy. The indicia may warn not to remove the canopy, or may warn of the consequences and or potential penalty for removing the canopy.

As noted above, in one embodiment of the invention, a plate or cup is provided at and end of the canopy distal from the surface. This surface may further serve to providing a location for written indicia or symbols, as well as to provide an aesthetic role, structural rigidity, or as an aid to manufacturing.

As discussed above, covers for fully recessed sprinkler heads are known, but these are not suitable for projecting sprinkler heads, and they further require additional means for conducting heat, and for dislodging the cover, that are cooperative with and dependent upon the particular physical design of the sprinkler head being deployed. Moreover, recessed sprinkler heads are not as vulnerable to tampering as exposed heads, and thus covers for recessed heads are not directed to or adapted to the problem of reducing the incidence of tampering.

As can be seen from the figures and the description, the canopy of the present invention is operative to deter tampering with a sprinkler head regardless of its design, and without a requirement for physical configuration or conformity with an existing sprinkler head. Thus, a canopy in accordance with the invention may be rapidly and easily added to an existing sprinkler system, without modification to the latter, and without requiring that an existing system be shut down or disturbed.

The canopy may be removed for testing or maintenance by authorized persons without a requirement for tools, and without adding significantly to the amount of time required to complete such a task. In this event, in accordance with the invention, switching means are provided to turn off an audible or remote alarm prior to removing the canopy. Switching may be by any known means, including a keyed or magnetic switch located on or within the canopy, or by disabling a remote alarm associated with one or more devices to be tested or maintained.

The invention works to prevent tampering by various modalities, in recognition of various tamperer intentions, as follows:

Tamperer 1/Concealment

Initially, there are potential tamperers who may not realize what a sprinkler head is, and may innocently and unknowingly connect or hang an object from a sprinkler head, and thus accidentally activate the sprinkler head, as by moving or dislodging a fusible link or bulb which maintains the sprinkler head in a sealed condition. By obscuring the sprinkler head, the present invention prevents a potential tamperer from viewing a possible attachment location, or from availing themselves of the attachment location. Accordingly, no attempt is made to use the sprinkler head as a point of attachment, and the sprinkler head is not accidentally activated.

Tamperer 2/Physical Act Requirement

Some individuals may become aware that a sprinkler head is concealed by a canopy in accordance with the invention, either by looking through the bottom of an embodiment without a bottom panel, or through recognition that a sprinkler head is likely to be under the canopy. If these individuals nonetheless wish to hang an object from the sprinkler head, they will first need to physically remove the canopy. Initially, they may be unaware that it is removable, and would thus be discouraged altogether. In all events, however, they must decide to deliberately tamper with an object which, as should be clear to a reasonable person, is not meant to be disturbed. Most individuals would, out of respect for private property and propriety, decide not to remove the canopy.

Tamperer 3/Warning Messages

Many individuals would heed a written warning, or alternatively an internationally recognized symbol, indicating that an object should not be touched or tampered with. Additionally warnings, such as legal penalties, may also be written upon or attached to the canopy. This additional aspect of the invention would discourage another segment of the population.

Tamperer 4/Potential Alarm or Activation

Individuals who would, despite the previous deterrents, continue to consider removing the canopy, might also consider the possibility that the device is alarmed, or alternatively, that removal of the canopy would precipitate activation of the sprinkler head. In addition, written warnings or markings may specifically warn of an alarm, or possible activation of the sprinkler head, as well as the potential consequences of these events. Thus, a further segment of the population would be dissuaded by these factors.

Tamperer 5/Alarm or Warning Activation

It is within the scope of the invention to activate an audible warning as the canopy is moved only a limited amount, and not yet detached from the mounting surface. In this manner, a startled potential tamperer may discontinue attempts to remove the canopy. A canopy in accordance with the invention could be configured to trigger a remote alarm upon such mere movement, as otherwise described herein.

Ultimately, however, a tamperer may remove the canopy, at which point, in accordance with the invention, a central desk or security officer is instantly notified by wired or wireless communication. In such an event, the tamperer's identity could become known, either by one or more cameras, or by being deduced based upon limited access to the sprinkler head, e.g. occupants of a hotel room. Aware of the possibility of being discovered, many individuals would stop tampering with the sprinkler head upon hearing the first audible alarm or recorded spoken warning.

Ultimately, however, a deliberate vandal may continue, at which point it is still possible for security personnel to arrive at the sprinkler head location before the sprinkler head is actually activated. Regardless of whether activation of the sprinkler head occurs, early warning made possible by the invention improves the likelihood that responsible individuals may be apprehended, and thus the invention serves to discourage tampering in the future.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein:

FIG. 1 depicts a canopy in accordance with the invention, mounted on a wall, positioned over a projecting sprinkler head;

FIG. 2 shows the canopy of FIG. 1, mounted on a ceiling;

DETAILED DESCRIPTION OF THE INVENTION

Figure 3:
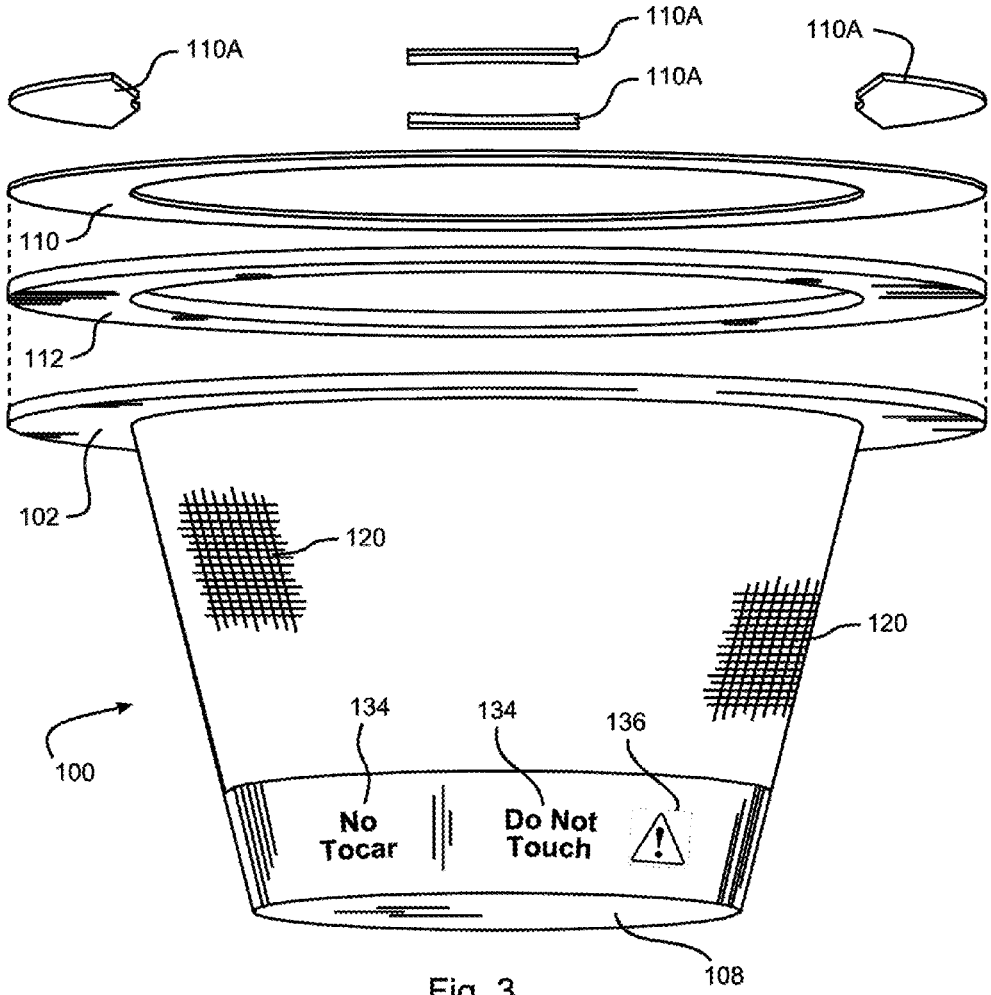
FIG. 3 depicts a canopy embodiment in accordance with the invention, including alternative mounting means, and indicia.

In the description which follows, any reference to direction or orientation is intended primarily and solely for purposes of illustration and is not intended in any way as a limitation to the scope of the present invention. Also, the particular embodiments described herein are not to be considered as limiting of the present invention.

Referring now to the figures, in which like reference numerals refer to like elements, the invention provides for discouraging and thereby reducing the incidence of tampering with fire safety equipment, and in particular, with exposed sprinkler heads 200,202 (hereinafter 200), as shown in FIGS. 1 and 2. In particular, sprinkler head 200 is obscured from view, and in addition, cannot be misused without removal of the device itself. A common form of misuse is the hanging of objects, such as garments on a hanger, from the sprinkler head bail arm 204 or other potential hanger support, including portions of the trigger assembly 206.

The invention is directed to sprinkler heads 200 in which a valve is held shut by a thermal linkage, such as linkage 214. The invention may be employed with all types of sprinkler heads, including conventional, horizontal sidewall, vertical sidewall, upright, pendent, and recessed pendent. The sprinkler head is activated normally by a weakening of thermal linkage 214 in the presence of heat. Typically, after 3 or 4 minutes of exposure to a predefined level of heat, the thermal link will collapse and release a cap, diaphragm or valve, whereupon water may be discharged. Shorter duration thermal linkages also exist. Activation through tampering, however, typically occurs due to the thermal link being moved out of place, or moved to the point of breakage.

In accordance with an embodiment of the invention, and with reference to FIGS. 1-2, a mesh or woven cover or canopy 100, sized to substantially surround or enclose an exposed portion of a sprinkler head 200, is provided with an engagement flange 102. To effectively impede activation through tampering, it is sufficient for the enclosure to at least substantially block or impede access to the trigger, usually accessed from the side of the sprinkler head. Canopy 100 has at least one open end 104, and in one embodiment, includes an open end 104, enclosed sides 106, and a closed end 108. A mounting or attachment plate 110, in one embodiment a ring shape having a diameter corresponding to the diameter of the canopy, is attached to surface 208,210 (hereinafter 210), wherein surface 208 is illustrative of a vertical wall surface, and surface 210 is illustrative of a horizontal ceiling surface, adjacent to sprinkler head 204. A magnet 112 is attached to either flange 102 or plate 110, whereupon the other of the two parts includes a magnet or magnetically active material, such as a ferromagnetic material. In this manner, the canopy is releasably retained upon the adjacent surface 210.

Figure 4A:
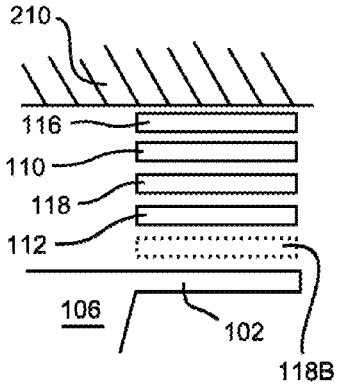
FIGS. 4A-4C illustrate alternative means of mounting a canopy in accordance with the invention.
Figure 4B:
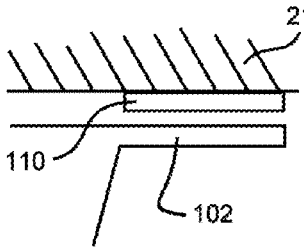
Figure 4C:
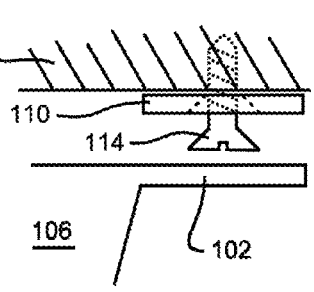

It should be understood that a variety of possible combinations of fastening or affixing means exist, within the spirit and scope of the invention, for releasably retaining canopy 100 upon surface 210. With reference to FIGS. 4A-C, it can be seen that plate 110 is affixed to surface 210 using screw 114. Any known fastener, such as a nail, pin, rivet, or any other known form of bonding, may be used to attach plate 110 to surface 210. As shown in FIG. 4B, either or both of plate 110 and flange 102 are magnetized, and are mutually attracted with no other intervening layers. If only one of plate 110 and flange 102 are magnetized, the other is magnetically active.

In an additional embodiment in accordance with the invention, hook and loop fasteners may be substituted for magnetized or magnetically active elements, as described herein. In this embodiment, either hook material or loop material is attached, as by adhesive or other means, to plate 110, and the complementary material is attached to flange 102. It is important, as it is with a magnetic attraction, to ensure that the attachment force is sufficient to retain canopy 100 in place, yet does not hinder release of the canopy in the event of sprinkler activation.

In accordance with an alternative embodiment of the invention, and with reference to FIG. 4A, attachment plate 110 is adhered to surface 210 by an adhesive layer 116 interposed between plate 110 and surface 210. Adhesive layer 116 may be provided in the form of double sided adhesive tape or foam, applied to either attachment plate 110 or surface 210, after which attachment plate 110 is bonded to surface 210. Adhesive layer 116 may be applied in a factory production process, or applied at the installation site. In both configurations, the unattached adhesive side or sides may be provided with a protective release layer, such as a wax or polymer coated paper (not shown), which is removed prior to application.

An additional adhesive layer 118 may be applied to plate 110, as shown in FIG. 4A, or may alternatively be applied to flange 102, and magnet 112 may then be adhered to adhesive layer 118.

In accordance with yet another embodiment of the invention, any of the aforementioned adhesive layers, such as layer 116, may include a heat sensitive adhesive composition, wherein the layer loses gripping strength in the presence of heat at a temperature equal to or below that of the sprinkler head trigger. This embodiment operates to further ensure separation of the canopy in the event of a fire.

In a further alternative in accordance with the invention, an adhesive layer, such as layer 116, is provided in the form of microcapsules or other composition which enables canopy 100 to be easily and effectively removed and reapplied repeatedly, through separation of the adhesive layer.

Figure 6:
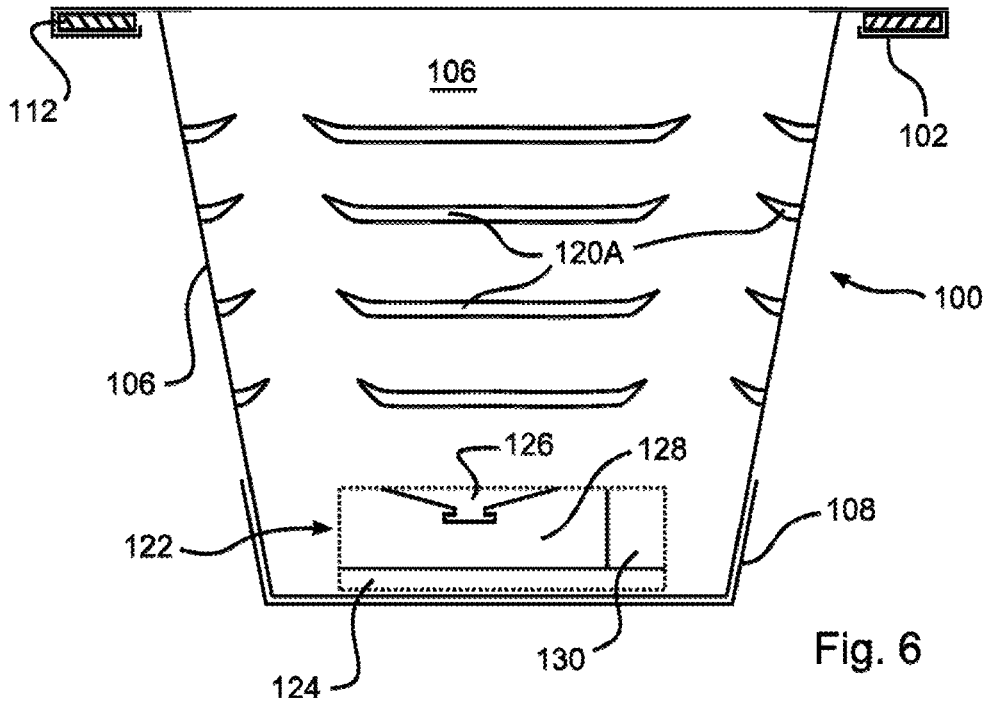
FIG. 6 depicts another alternative canopy in accordance with the invention, including heat conducting apertures, audible means for notification of movement, and means for securing a magnetically charged element.

Magnet 112 may also be affixed to flange 102 or plate 110 through known mechanical means, including a mechanical enclosure, as is shown in FIG. 6.

In another alternative, during new construction in particular, attachment plate 110 may be adhered to the ceiling when same is wet and curing, or through the application of liquid glue to plate 110, surface 210, or both.

In another embodiment, a device in accordance with the invention is attached to escutcheon 212, either magnetically, or through an adhesive layer as otherwise described herein, with respect to attachment to the surface.

Due to the open weave of the canopy, or through at least one sufficiently sized aperture, heat may readily enter the canopy and activate the sprinkler head as intended. When the sprinkler head is activated, discharged water engages the mesh 120 of the canopy, and or a plate disposed at a closed end 108 of canopy 100, and by action of water pressure, canopy 100 is pushed away, breaking a magnetic bond which is configured to be weak relative to the force of released water, and releasing the canopy from the surface, as described above. The ready admission of heat, combined with a quick release of the canopy, ensures no significant impact to the performance of the fire suppression system.

Figure 5:
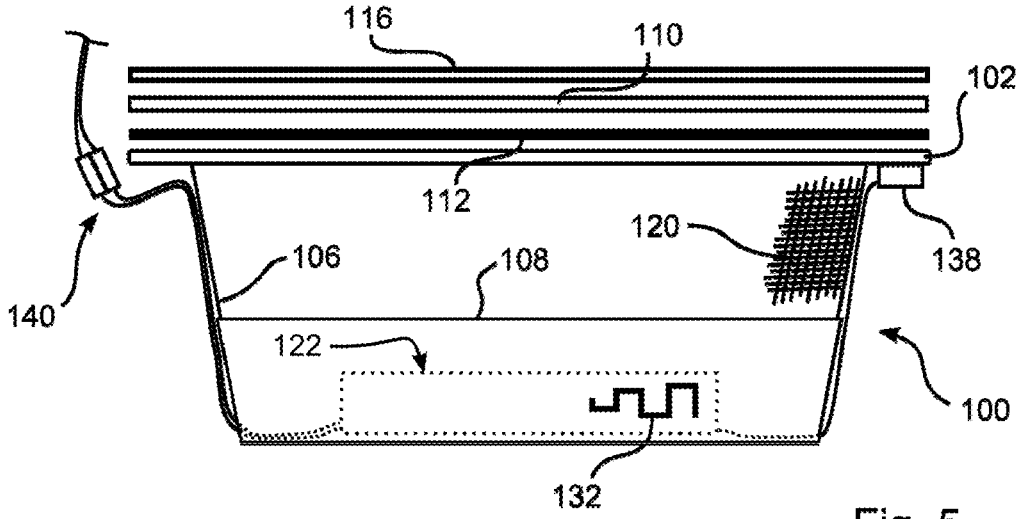
FIG. 5 depicts an alternative canopy in accordance with the invention, including means for communicating removal and replacement of the canopy to a central location.

It should be understood that only a portion of mesh 120, shown in FIGS. 3 and 5, is illustrated, and that additional areas of mesh extend along sides 106 and or bottom 108 of canopy 100. All or a portion of canopy 100 may be fabricated of mesh 120, except as otherwise provided herein. Mesh 120 may be formed of a variety of materials, including plastic, wire, stainless steel, stainless steel wire, metalized plastic, injection molded plastic, galvanized metal, or other metal. The aperture size of mesh 120 is selected to advantageously visibly obscure sprinkler head 200, reducing a temptation to use sprinkler head 200 for an improper purpose. Concomitantly, the aperture or mesh 120 size must be large enough to avoid adversely impacting the performance of the sprinkler head, and more particularly, must not introduce a measurable or significant delay in activation. The mesh size is further chosen in consideration of factors affecting separation of canopy 100 from surface 210. These include the amount of water pressure impacting mesh 120, the overall surface area of mesh 120, and if present, bottom 108, the strength of the magnetic attachment, and the speed with which it is desired to dislodge canopy 100. Mesh aperture sizes in a range of about 0.015 to 0.030 inches are provided in a typical embodiment, although larger or smaller apertures may be provided based upon, at least, the factors listed.

A canopy in accordance with the current invention may be provided in a variety of sizes, depending in part upon the factors for separation described above, and the extent to which the sprinkler head extends from or protrudes through surface 210. In a sprinkler configuration where sprinkler head 200 extends 2 inches from surface 210, a canopy advantageously has a length of 3 inches, a width of 3 inches proximal to surface 210, and a width of 2 inches distal to surface 210. In this illustrative embodiment, engagement flange has a width of one quarter inch. Similarly, plate 110 has a matching width of at least one quarter inch. Larger or smaller sprinkler heads, or larger or smaller sprinkler head protrusions, would indicate a commensurate change in dimensions, so that there is adequate passage of heat for activation, and timely separation in the event sprinkler head 202 is triggered, as described. Dimensions are, of course, different for each of the varied canopy shapes. It is desirable for the canopy to be sized so that a tamperer does not have ready access to trigger 214 of sprinkler head 202. In particular, dimensions are selected wherein access to trigger 214, as by fingers or the hook of a clothes hanger, is impeded sufficiently to dissuade misuse or tampering with the sprinkler head.

While the canopy is meshed in one embodiment, it should be understood that slits 120A or other aperture shapes may be provided in the canopy surface, provided that consideration of the factors described above, for mesh, are considered in determining the optimum quantity, location, and size of apertures. There must be sufficient passageway for heat, and thus sprinkler activation, as well as sufficient surface area to engage discharged water and thus dislodge canopy 100.

A variety of materials can be used in the construction of canopy 100, including plastic, metal, or composites. For an attractive finish, stainless steel or vacuum metalized plastic may be used. In humid or corrosive atmospheres, a corrosion resistant material, such as plastic, stainless steel or galvanized metal, is advantageous. A canopy 100 in accordance with the invention may also be painted or camouflaged using any known means, provided apertures in mesh 120 or slits 120A are maintained unobstructed.

In a typical sprinkler head installation, escutcheon 212, usually ring shaped, covers the cut or exposed surface through which sprinkler head 200 projects. In accordance with the invention, attachment plate 110 is sized larger than escutcheon 212 in order to surround same, enclosing it within canopy 110. The invention thus enables escutcheon 212 to be omitted, reducing construction costs. Canopy mesh 120 size may be selected to visually obscure an exposed wall surface within the canopy, while adequately admitting heat.

In one embodiment, attachment plate 102 is a plastic or metallic ring with magnetic material 112 bonded or otherwise affixed thereto. Alternatively, attachment plate 102 may be a ring shaped magnet, or ring of magnetized material. Where engagement flange 102 contains magnetic material, the attachment ring may merely be magnetically active, for example containing a ferrous material. Both engagement plate 102 and attachment plate 102 may alternatively be magnetic; however in this embodiment the respective poles must be appropriately aligned on each surface in order to produce an attraction therebetween.

Moreover, while canopy 100 is advantageously manufactured in a round shape, such as a cylinder or conical frustum (as illustrated in the figures), a pyramidal frustum or other shape which is sized to enclose sprinkler head 200 may be used, and is therefore contemplated as within the scope of the invention.

Similarly, attachment plate 110 is provided with a shape complementary to canopy engagement flange 102. Further, the attachment plate may be composed of a plurality of discrete elements 110A which are separately attached to the surface, thereby reducing the total amount of material needed. In this event, a template (not shown) may be provided to facilitate attachment, or alternatively, the discrete elements 110A may be magnetically connected first to engagement flange 102, and subsequently adhered or attached to surface 210 after being thus properly aligned.

In accordance with a further embodiment of the invention, an audible device 122 is connected to the canopy, operative to respond to a movement of canopy 100. The sound device 122 emits an alarm noise, or plays a recorded message in at least one language, notifying individuals proximate the canopy not to move or remove the canopy from its installed location. Sound device 122, in one embodiment, is an electronic circuit 128 including power supply means 124 and a sound transducer 126. Electronic circuit 128 is responsive to movement of the canopy, as by incorporation of means for detecting motion 130, or through interaction with a switch 138 engaged through proximity with, or contact with, plate 110. The message may further warn of the rationale or consequences of a failure to heed the warning. In addition, the message may repeat until the device is replaced in its correct location, or a specified time has elapsed. Detection of replacement or removal of the device may be by switch 138, or other means known in the art.

It should be understood that, in accordance with the invention, it is advantageous for the audible warning to be given as soon as canopy 100 is moved even slightly, before it is yet removed from its mounting. Thus, a potential tamperer may be encouraged to abandon an attempt while canopy 100 is still attached. This may be accomplished, for example, through the inclusion of a motion sensor (not shown).

In addition to, or in place of an audible message, a signal may be sent to a central administration site, as by wire 140 or wireless 132 transmission, whereby persons responsible for maintenance or safety can ensure that canopy 100 is replaced, or that further measures may be taken to ensure that the sprinkler system is not tampered with further. Advantageously, wireless communication could utilize the same computer wireless LAN as may be found in many hotels or office buildings, wherein electronic circuit 128 includes means for transmitting a signal through the wireless local area network (LAN) to central administration, including identifying information for the particular canopy or location. A cellular telephone network, or a simple radio network could similarly be employed.

Alternatively, individual canopies 100 may be wired directly to a central location, or may be connected by wire 140 to satellite relay devices (not shown) which connect by wire or wireless connection, as described. By reducing the number of communication devices required, costs could be reduced.

In a further alternative in accordance with the invention, each canopy 100 is provided with a low cost, low power, short distance radio transponder 128,132, which relays a tamper signal to a relay or satellite device, the latter communicating over a longer distance network, such as the LAN network described, a wide area network (WAN), or the internet, or though a telephone, satellite, or cable network.

In accordance with another embodiment of the invention, written indicia 134, either symbolic 136 or in at least one written language, are provided in a prominent visible location on canopy 100. The indicia may warn not to touch or remove the canopy, or may warn of the consequences and or potential penalty for removing the canopy.

As noted above, in one embodiment of the invention, a plate or cup 108 is provided at one end of the canopy, distal from the surface. This surface may further serve to providing a location for written indicia or symbols, as well as to provide an aesthetic role, structural rigidity, or as an aid to manufacturing. Cup 108 further serves as a solid base upon which to support and conceal electronic components.

Figure 7:
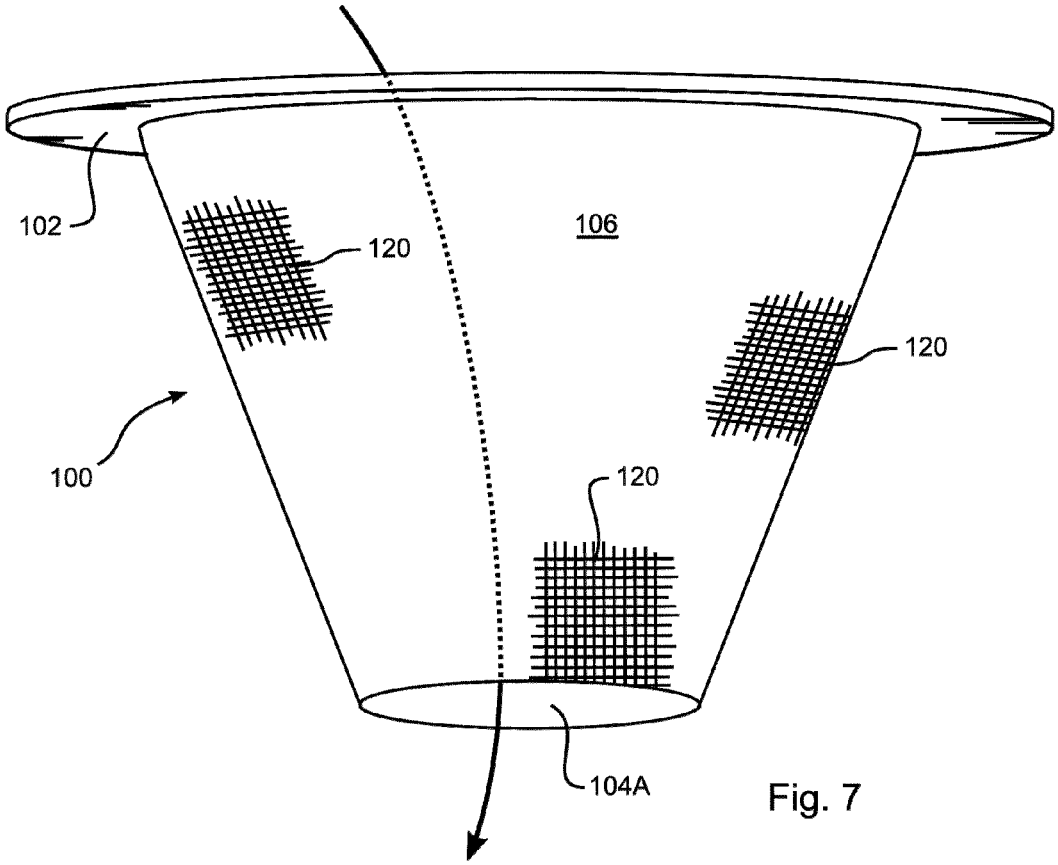
FIG. 7 depicts a further alternative canopy in accordance with the invention, having an open bottom.

In an alternative embodiment in accordance with the invention, and with reference to FIG. 7, canopy 100 has two open ends, 104,104A, as indicated by arrow "A". To increase resistance to discharged water, sufficient to ensure separation of canopy 100 from surface 210, sides 106 may advantageously be provided with a greater taper than is provided for embodiments having a closed end 108, or a reduced mesh 120 or aperture 120A size. Moreover, to further discourage tampering, opening 104A is sized sufficiently small to render difficulty in accessing the sprinkler head within, particularly with respect to admitting fingers or a hanger hook.

All references cited herein are expressly incorporated by reference in their entirety. In addition, unless mention was made above to the contrary, it should be noted that all of the accompanying drawings are not to scale. There are many different features to the present invention and it is contemplated that these features may be used together or separately. Thus, the invention should not be limited to any particular combination of features or to a particular application of the invention. Further, it should be understood that variations and modifications within the spirit and scope of the invention might occur to those skilled in the art to which the invention pertains. Accordingly, all expedient modifications readily attainable by one versed in the art from the disclosure set forth herein that are within the scope and spirit of the present invention are to be included as further embodiments of the present invention.

What is claimed is:

1. An apparatus for discouraging tampering with a sprinkler head of the type activated to discharge water when the sprinkler head is exposed to a predefined temperature or a trigger is moved, where the sprinkler head projects from a surface of a habitable structure into an area to be protected from fire, the apparatus comprising:

magnetically active mounting means mountable to the surface;

an enclosure sized to substantially impede access to a trigger of the sprinkler head, at least a portion of said enclosure disposed to lie within an expected path of water discharged by the activated sprinkler head, and further including at least one aperture operative to admit heat from the area to the sprinkler head; and magnetically active coupling means connected to said enclosure, sized and disposed to magnetically engage at least a portion of said mounting means, whereupon said enclosure is magnetically retained upon the surface to impede access to a trigger of the sprinkler head;

wherein when said sprinkler head is activated, said enclosure is pushed by discharged water, and said enclosure is thereby detached from the surface; and wherein tampering is discouraged in that a tamperer must remove said enclosure in order to readily tamper with the sprinkler head by moving or damaging the sprinkler head trigger to cause activation of the sprinkler head.

2. The apparatus of claim 1, further comprising indicia disposed upon said enclosure, operative to warn against disconnecting said enclosure from said mounting means.

3. The apparatus of claim 1, wherein said mounting means includes a magnetically active material and adhesive, the adhesive operative to connect said magnetically active material to the surface.

4. The apparatus of claim 1, wherein said enclosure has a frustoconical shape.

5. The apparatus of claim 1, wherein said enclosure is fabricated with wire mesh.

6. The apparatus of claim 1, wherein at least one of said mounting means and said coupling means includes magnetized material.

7. The apparatus of claim 6, wherein at least one of said flange and said mounting means includes magnetized material.

8. The apparatus of claim 1, wherein said magnetically active coupling means includes a flange connected to said enclosure, shaped to form a contact surface mateable to said mounting means.

9. The apparatus of claim 1, wherein said enclosure is sized to prevent insertion of a clothing hanger hook therewithin.

10. The apparatus of claim 1, wherein a sprinkler head defines one or more sides through which a trigger may be accessed and moved, and an end portion, and said enclosure further includes a side portion substantially impeding access to said one or more sprinkler sides, and an end panel substantially impeding access to said sprinkler end.

11. The apparatus of claim 1, wherein said enclosure substantially surrounds that portion of the sprinkler head which projects from the surface into the area.

12. The apparatus of claim 1, wherein said mounting means are affixed to the surface using means selected from the group consisting of: double sided adhesive foam, double sided tape, mechanical fastener, pin, screw, nail, nut and bolt, glue, adhesive.

13. The apparatus of claim 1, wherein said enclosure is fabricated from a material selected from the group consisting of: plastic, wire, stainless steel, stainless steel wire, metalized plastic, injection molded plastic, galvanized metal, metal.

14. The apparatus of claim 13, wherein said enclosure is a frustoconical shaped wire mesh, further including an end plate.

15. The apparatus of claim 1, wherein said mounting means and said coupling means are magnetized metal.

16. The apparatus of claim 1, wherein said coupling means further include a flange;

at least one magnet;

means for retaining said at least one magnet in contact with said flange.

17. The apparatus of claim 1, wherein said mounting means comprise a magnetically active metal ring, and said coupling means comprise a magnetically active metal flange extending from said enclosure, at least one of said ring or flange being magnetized.

18. An apparatus for discouraging tampering with a sprinkler head of the type activated to discharge water when the sprinkler head is exposed to a predefined temperature or a trigger is moved, where the sprinkler head projects from a surface into an area to be protected from fire, the apparatus comprising:

at least one magnetically active mounting plate affixable to the surface;

an enclosure sized to substantially surround that portion of the sprinkler head that projects from the surface, thereby impeding access to a trigger of the sprinkler head, at least a portion of said enclosure disposed to lie within an expected path of water discharged by the activated sprinkler head, and further including at least one aperture operative to admit heat from the area to the sprinkler head; and at least one magnetically active enclosure flange connected to said enclosure, sized to magnetically and matingly engage said at least one mounting plate, whereupon said enclosure is magnetically retained upon the surface to surround that portion of the sprinkler head which projects from the surface;

wherein when said sprinkler head is activated, said enclosure is pushed by discharged water, and said enclosure is thereby detached from the surface; and wherein tampering is discouraged in that a tamperer must remove said enclosure in order to readily tamper with the sprinkler head by moving the sprinkler head trigger to cause activation of the sprinkler head.

19. The device of claim 18, wherein said enclosure comprises a mesh canopy configured to block access to the trigger from any direction once said enclosure is magnetically and matingly engaged to said at least one mounting plate.

20. A method for discouraging tampering with a sprinkler head of the type activated to discharge water when the sprinkler head is exposed to a predefined temperature or a trigger is moved, where the sprinkler head projects from a wall or ceiling surface into an area to be protected from fire, comprising the steps of:

affixing at least one magnetically active mounting plate to the surface;

impeding access to a trigger of the sprinkler head by substantially surrounding that portion of the sprinkler head that projects from the surface with an enclosure, without a requirement to contact the sprinkler head, at least a portion of the enclosure disposed to lie within an expected path of water discharged by the activated sprinkler head, the enclosure further including at least one aperture operative to admit heat from the area to the sprinkler head; and connecting the enclosure to the at least one magnetically active mounting plate using an enclosure flange connected to said enclosure, sized to magnetically and matingly engage the at least one mounting plate, whereupon the enclosure is magnetically retained upon the surface to surround that portion of the sprinkler head which projects from the surface;

wherein when said sprinkler head is activated, said enclosure is pushed by discharged water, and said enclosure is thereby detached from the surface; and wherein tampering is discouraged in that a tamperer must remove said enclosure in order to readily tamper with the sprinkler head by moving the sprinkler head trigger to cause activation of the sprinkler head.

* * * * *